US005863408A

United States Patent [19]

Ikegaya

[11] Patent Number: 5,863,408

[45] Date of Patent: Jan. 26, 1999

[54] METHOD AND DEVICE FOR SURFACE TREATMENT

[75] Inventor: Hirohiko Ikegaya, Iwata, Japan

[73] Assignee: Yamaha Hatsudoki Kabushiki Kaisha, Iwata, Japan

[21] Appl. No.: 656,920

[22] Filed: Jun. 3, 1996

[30] Foreign Application Priority Data

Jun. 6, 1995 [JP] Japan ..... 7-139664

[51] Int. Cl.[6] ..... C25D 5/34; C25D 17/00; B05B 5/025; B08B 3/00

[52] U.S. Cl. ..... 205/210; 205/122; 205/128; 205/131; 205/132; 205/133; 205/145; 205/146; 205/205; 204/198; 204/203; 204/224 R; 204/226; 118/622; 118/624; 118/627; 118/423; 15/104.011; 15/104.11; 134/152; 134/169 A

[58] Field of Search ..... 204/198, 203, 204/224 R, 226; 205/122, 128, 131, 132, 133, 145, 146, 205, 210; 118/622, 624, 627, 423; 15/104.011, 104.11; 134/152, 169 A

[56] References Cited

U.S. PATENT DOCUMENTS

| | | | |
|---|---|---|---|
| 5,069,760 | 12/1991 | Tsukamoto et al. | 204/198 |
| 5,100,516 | 3/1992 | Nishimura et al. | 204/145 |
| 5,552,026 | 9/1996 | Ikegaya et al. | 204/224 R |
| 5,580,383 | 12/1996 | Ikegaya et al. | 204/224 R |

FOREIGN PATENT DOCUMENTS

| | | |
|---|---|---|
| 703356 | 3/1996 | European Pat. Off. . |
| 2902352 | 7/1980 | Germany . |

OTHER PUBLICATIONS

European Search Report Nov. 18, 1996.

*Primary Examiner*—Kathryn L. Gorgos
*Assistant Examiner*—Edna Wong
*Attorney, Agent, or Firm*—Knobbe, Martens, Olson & Bear LLP

[57] ABSTRACT

A method and apparatus for performing high speed chemical treatment of v type cylinder blocks. First the cylinder bores of one bank are treated. Then those of the other bank are treated. This permits a simple but compact treating plant.

33 Claims, 13 Drawing Sheets

METHOD AND DEVICE FOR SURFACE TREATMENT

BACKGROUND OF THE INVENTION

This invention relates to a method and device for surface treatment and more particularly to a method and apparatus for surface treating cylinder blocks of reciprocating machines having angularly disposed cylinder banks.

There have been proposed very effective methods and apparatus for surface treating the cylinder bores of a cylinder block. The cylinder bores may be surface treated for a variety of purposes, the main of which is to plate a hardened coating on the base cylinder block material. By plating cylinder blocks in this method, it is possible to use light alloy-based blocks and still have the desired cylinder wall surface and surface properties.

Such a plating technique has been found useful in permitting lighter weight cylinder blocks than possible when utilizing pressed or cast-in cylinder liners, as was the previous practice. Although plating has been an alternative to the use of pressed or cast-in liners, conventional plating processes are not particularly adapted for use with cylinder blocks. There are a number of reasons for this.

The first of these reasons has to do with the fact that in conventional plating processes, the entire article to be plated is submersed in the electrolytic solution. Thus, if it is desired only to plate the cylinder bores, then some form of stopping off for the other surfaces of the cylinder block must be employed.

In addition to this disadvantage, conventional dip-type plating has a number of other generally objectionable characteristics. That is, the plating baths are quite environmentally unfriendly, and the handling of the plating fluids, subsequent washing, cooling, and drying presents significant problems.

Therefore, there has been proposed a plating method wherein the surface to be plated is hydraulically sealed and a plating electrolyte fluid is passed through the area across the surface to be plated. An electrical potential is generated, and the plating of the desired surface can be accomplished quickly and in a generally environmentally safe manner.

When plating cylinder bores, it is possible, for example, to place the cylinder block with one end of the cylinder bore in sealing relationship with a supporting base. A hollow electrode is then passed through the cylinder bore, and the other end of the cylinder bore is sealed. The plating fluid is then passed through the narrow area between the outer surface of the electrode and the inner surface of the cylinder bore at a high velocity.

With this type of system, a very good plating layer can be accomplished in a very quick time and in a generally environmentally safe manner. In addition, the washing and other environmental protection required with dip-type plating are significantly improved. In fact, this type of plating method and apparatus can be utilized on a production line where other machining and finishing operations are performed on the cylinder block.

However, the type of method and apparatus previously utilized for this purpose has generally been limited to arrangements wherein the cylinder block has in-line cylinders. If in-line cylinders are employed, several cylinders may be plated at the same time. In addition, the other surface treatments required for the plating process can also be performed in a similar manner.

However, the previously proposed methods and apparatus have not lent themselves to practice with engines having their cylinder bores aligned in an angular relationship to each other. Said another and more simple way, these previously proposed methods and apparatus have not lent themselves to utilization with V-type cylinder blocks.

It is, therefore, a principal object of this invention to provide an improved method and apparatus for surface treating the cylinder bores of engines having angularly disposed cylinder banks and cylinder bores.

It is a further object of this invention to provide an improved method and apparatus for plating cylinder blocks having angularly disposed cylinder bores wherein the plating process can be accomplished with conventional type equipment utilized for in line cylinders.

As should be apparent from the foregoing description, the presently proposed plating and surface treatment apparatus and methods for cylinder blocks has been generally limited to the use of application to in line cylinder blocks. This is generally because of the fact that a seal must be established at each end of each cylinder bore. Where the cylinder bores are angularly disposed, then a problem arises in conjunction with the simultaneous sealing of a plurality of nonaligned cylinder bores.

It is, therefore, a still further object of this invention to provide an improved method and apparatus for surface treating the cylinder bores of cylinder blocks having angularly disposed relationship.

In accordance with a feature of the invention, as will be described later under the heading entitled "Summary of the Invention", the plating or surface treatment of cylinder blocks having angularly disposed cylinder bores is facilitated by first surface treating all cylinder bores that are aligned in one plane and then surface treating those cylinder bores that are aligned in another plane. Obviously, this requires manipulation of the cylinder block, and also may significantly increase the space required for the surface-treating mechanism.

It is, therefore, a still further object of this invention to provide an improved plating apparatus and method wherein cylinder blocks having angularly disposed cylinder bores may be surface treated and wherein the apparatus and method is such that the actual space required on an assembly or production line is minimized.

SUMMARY OF THE INVENTION

A first feature of this invention is adapted to be embodied in a method and apparatus for chemically treating the cylinder bores of a cylinder block having a pair of angularly inclined cylinder banks, each having at least one cylinder bore formed therein. The apparatus includes a treatment section for establishing a flow of treating fluid through a cylinder bore from one end to the other for chemically treating the cylinder bore.

In accordance with an apparatus for performing the invention, a manipulating device is provided for moving the cylinder block through the treatment section. Means are associated with the manipulation device for first placing the cylinder block in an orientation for flow of the fluid through one of the cylinder bores and then in another angularly displaced orientation for flow through the other of the cylinder bores.

In accordance with a method for practicing the invention, the cylinder block is first positioned in the treatment section to establish a flow of treating fluid through one of the cylinder banks in an axial direction along the cylinder bore formed therein for chemical treatment. The cylinder block is then moved so as to permit a flow of treating fluid through the cylinder bore of another cylinder bank from one end to the other.

A further feature of the invention is also adapted to be embodied in an apparatus and method for chemically treating the cylinder bores of a cylinder block having a pair of angularly inclined cylinder banks, each having at least one cylinder bore formed therein. The apparatus is comprised of a pair of parallel conveyors disposed with paths lying in side-by-side relationship. A treatment section is provided along at least one of the paths and is adapted to provide an area for a flow of treating fluid through a cylinder bore from one end to the other for chemical treating of the cylinder bore.

In accordance with an apparatus for performing the invention, the cylinder block is moved along the one path for chemical treatment of one of the cylinder banks in a first orientation. The cylinder block is then transferred to the other line, and means are provided for subsequently treating the cylinder bores of the other cylinder bank.

In accordance with a method for practicing the invention, the cylinder block is transferred along one line in one direction for chemical treatment of one cylinder bank. The cylinder block is then transferred to the other line and reoriented for subsequent treating of the other cylinder bank.

DETAILED DESCRIPTION OF THE PREFERRED EMBODIMENTS OF THE INVENTION

Figure 1:
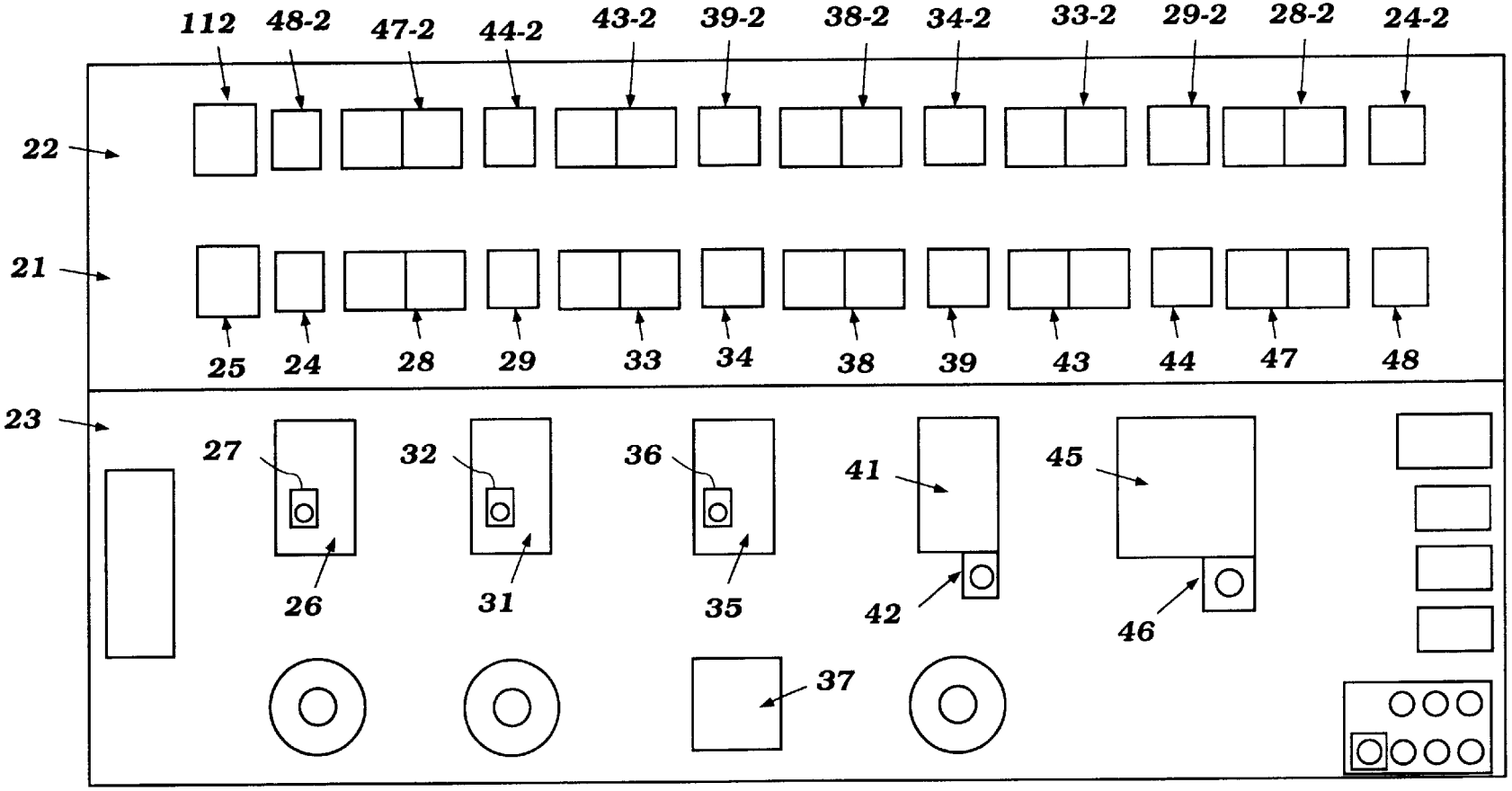
FIG. 1 is a top plan view of a treatment plant constructed and operated in accordance with a first embodiment of the invention, with a number of the components being shown schematically.

The treating apparatus will be described initially primarily to FIG. 1. FIG. 1 is a top plan view that shows a treating plant that embodies and can be utilized to practice the method of the invention. In accordance with this embodiment, the plant includes two treating lines 21 and 22 that are disposed in side-by-side, generally parallel extending relationship on the floor of the plant. Next to the line 21 is a space that contains a plurality of treatment tanks and circulating pumps, in an area indicated generally by the reference numeral 23.

The first line 21 includes a preliminary treating section that is comprised of a degreasing section 24 that is positioned immediately downstream of a work feeding section 25. The degreasing station 24 is supplied with degreasing fluid from a storage tank 26 positioned in the tank area 23 and which degreasing fluid is circulated by a recirculating pump 27. Suitable conduits and controls of a known type are provided for this purpose. When describing the plating section later, there will be reference to one specific way in which the storage and treating tanks can be interconnected.

Downstream of the degreasing section 24 there is provided a water washing station 28 that is employed to wash the degreased workpieces. The washing station 28 may include a pair of side-by-side dip tanks through which water is circulated for cleaning purposes.

Next, there is provided an alkali etching treatment station 29. Adjacent the station 29 in the area 23 is the alkali storage tank 31 and circulating pump 32. Alkali treating fluids are circulated from the tank 31 into the station 29 and returned by the pump 32 through suitable conduits.

Again, there is provided a further washing station 33 in which the alkali-treated workpieces are washed. Like the washing station 28, the washing station 33 can have two sequential washing tanks.

Following the second washing station 33 is another pre-treatment section 34 which is, in a preferred embodiment, a mixed-acid etching section. The etching acids are circulated through this station 34 from an acid storage tank 35 disposed in the area 23 and which is circulated by a pump 36. A mixed acid discharge tank 37 is disposed adjacent the acid storage tank 35 and receives spent acid for subsequent discharge in an appropriate manner. Again, the conduit for circulating the mixed-acid treating fluid can be of any known type.

Following the mixed-acid treating station 34, there is provided an additional water washing station 38. Like the previous washing stations 28 and 33, the washing station 38 may be a double tank if desired.

After the third washing, there is provided an aluminite-treating station 39 in which the workpieces are treated with aluminite treating. Aluminite for this treating is circulated from a storage tank 41 in the section 23 by a further circulating pump 42. Again, any suitable conduits can be utilized for providing the circulating. A further washing station 43, which may also include two water tanks, follows the aluminite-treating station 39.

Figure 6:
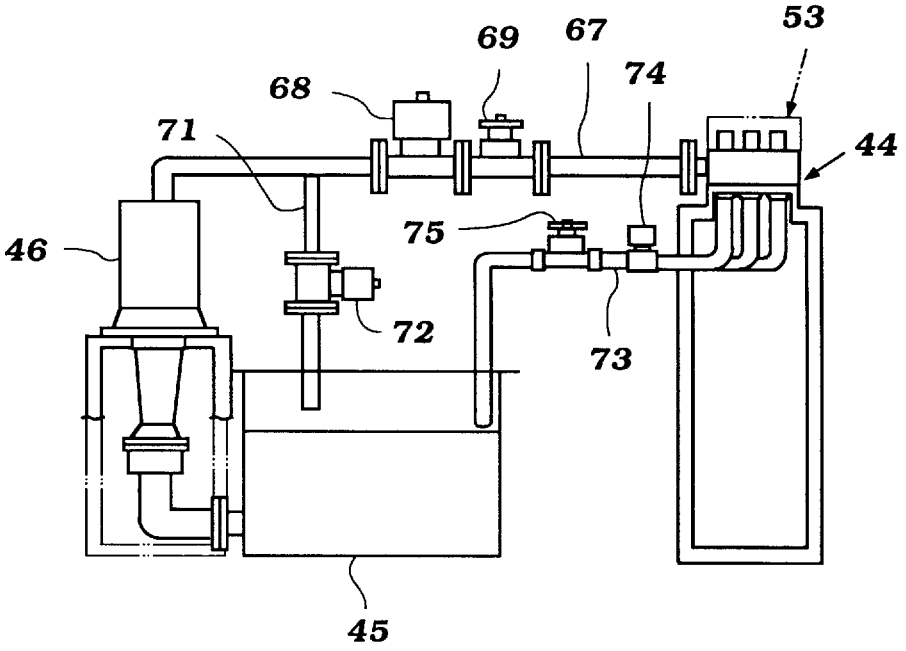
FIG. 6 is a partially schematic view showing the plating mechanism.
Figure 10:
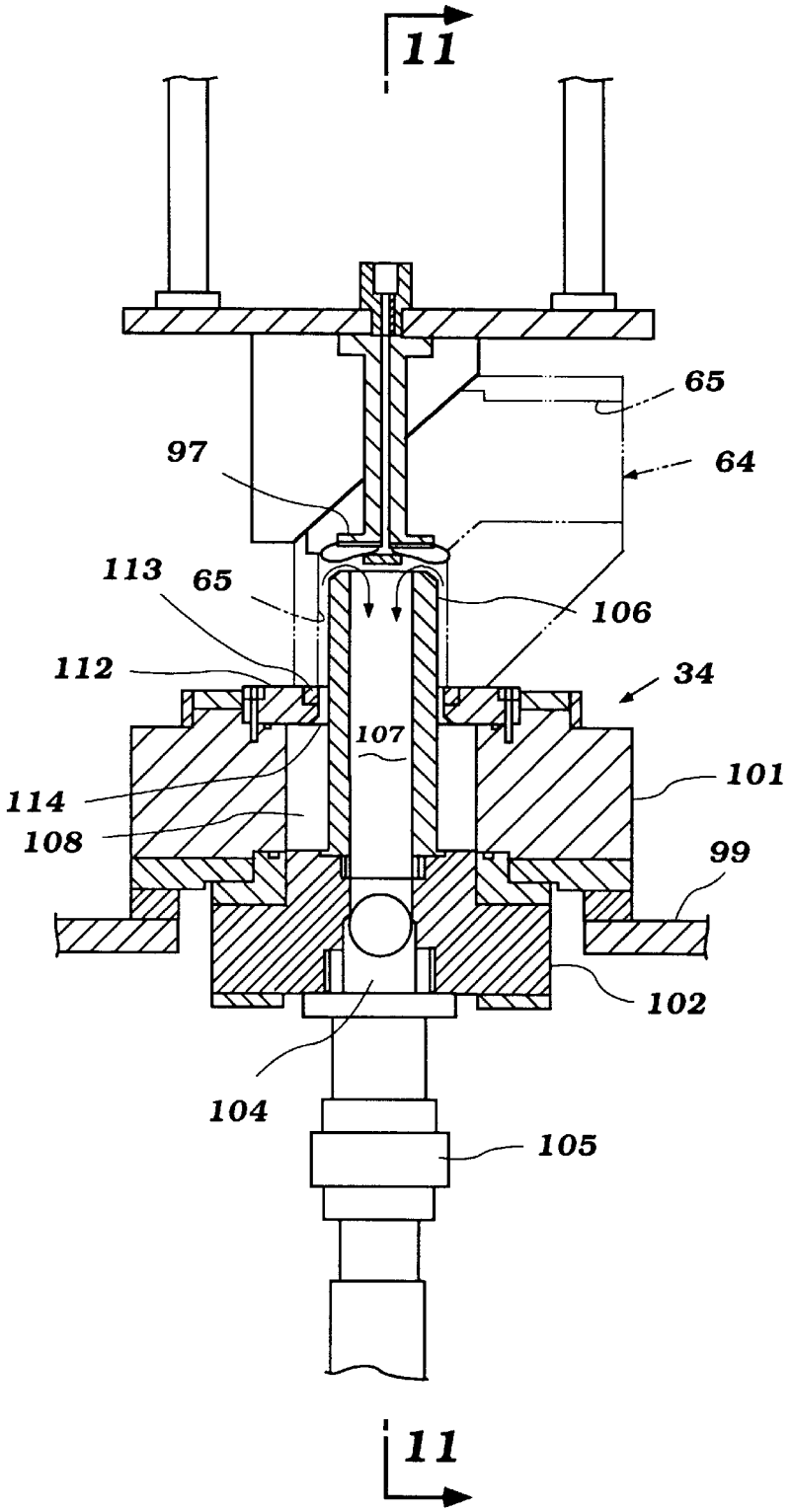
FIG. 10 is a cross-sectional view, in part similar to FIG. 7, and shows another of the treating sections and specifically one of the pre-treating sections.
Figure 11:
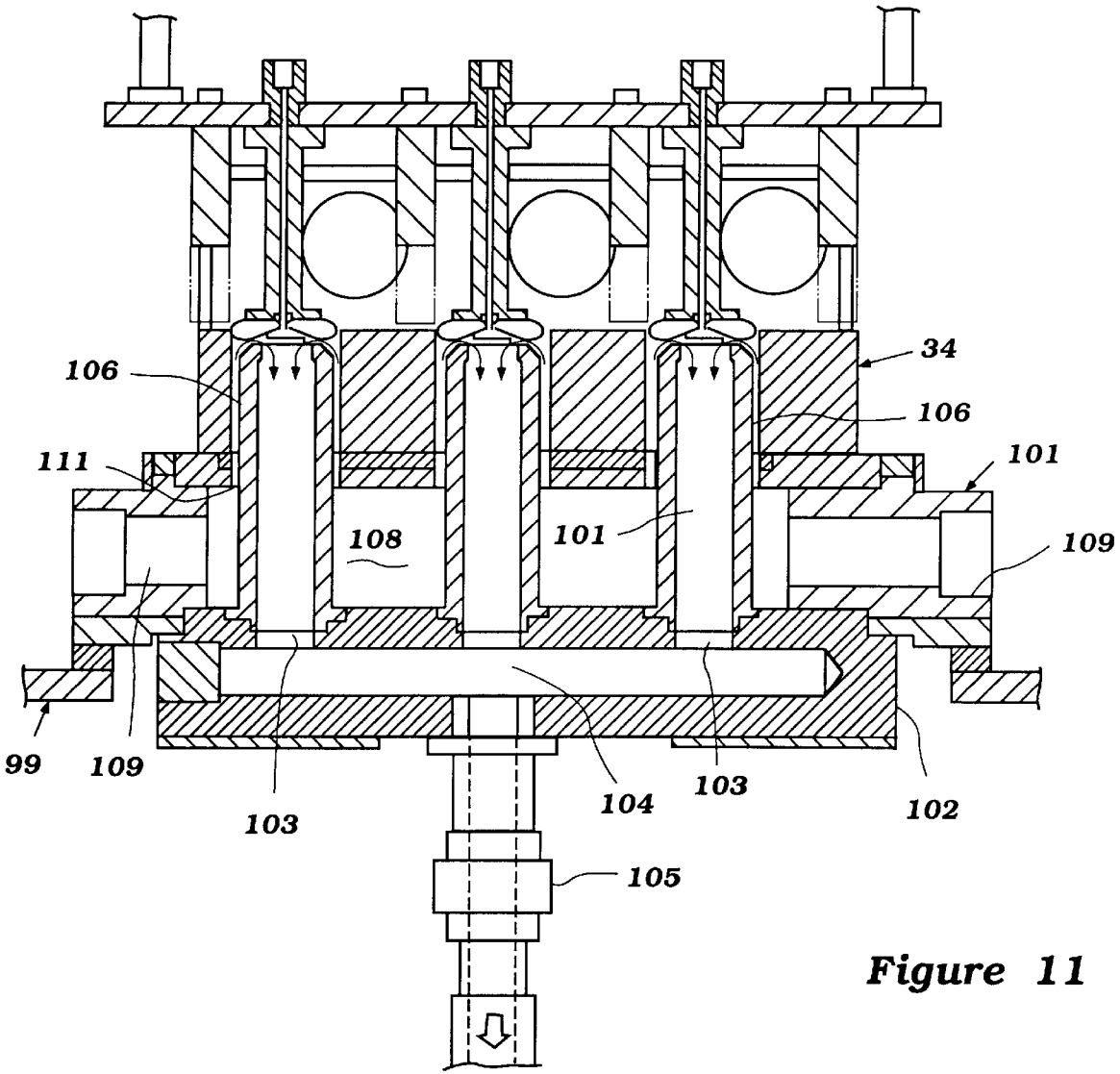
FIG. 11 is a cross-sectional view taken along the line 11—11 of FIG. 10 for this other treating section.

Having undergone the pre-treating operations in the stations 24, 29, 34, and 39, the workpiece is then delivered to the high-speed plating station 44. Plating fluid is circulated to this station 44 from an electrolyte storage tank 45 by a circulating pump 46. A specific example of how the conduitry for this station operates is shown in FIG. 6 and will be described later by reference to that figure. In addition, the actual apparatus in the high-speed plating section 44 is depicted in more detail in FIGS. 7–9. Also, an example of a pre-treating station which can be one of the stations 24, 29, 34, and 39 is shown in FIGS. 10 and 11 and will be described later by reference to those figures.

Following the high-speed plating operation in the station 44, the workpieces are then subjected to a further wash in a washing station 47. Like the earlier described washing stations 28, 33, 38, and 43, this station may be a double-tank station if desired. Finally, the workpieces which have been treated in the pre-treating stations and then plated in the plating station 47 are transferred to a drying station 48 where they may be dried.

Figure 2:
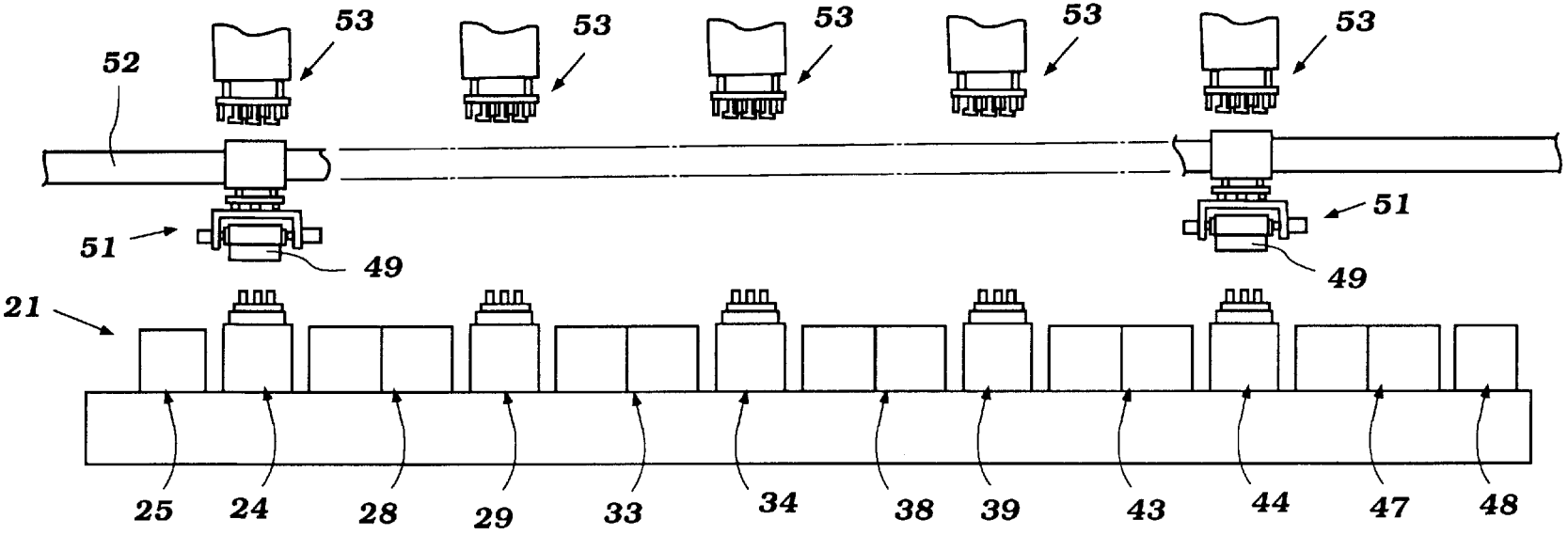
FIG. 2 is a side elevational view showing one portion of the plant shown in FIG. 1.
Figure 3:
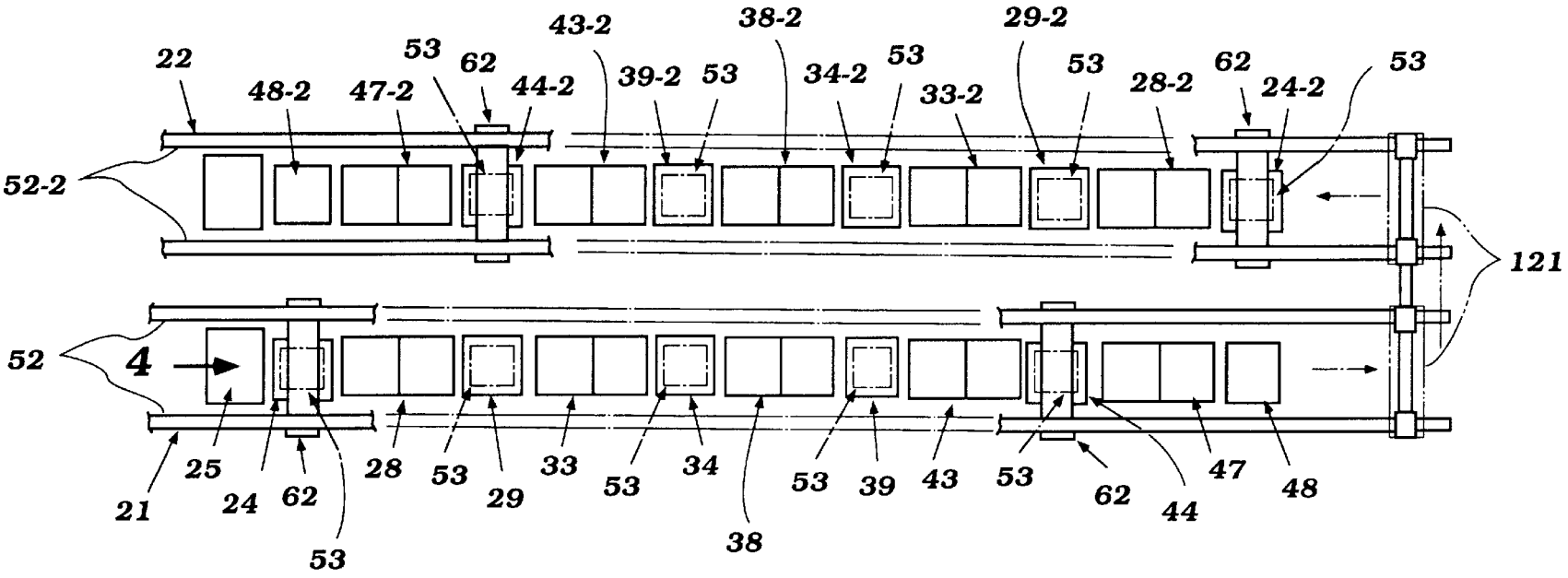
FIG. 3 is a further enlarged, top plan view, in part similar to FIG. 1 but in less schematic form, and showing the transfer mechanisms for treating the cylinder blocks in accordance with the method and apparatus.

The manipulating or conveying apparatus for moving the workpieces through the stations as described will now be described in more detail by reference to FIGS. 2–5. FIG. 2 is a side elevational view of the portion of the line 21 shown in FIG. 1, whereas FIG. 3 is a top plan view of the lines 21 and 22 but showing the conveyor sections in place. The actual conveyor apparatus is shown in FIGS. 4 and 5 and will be described subsequently by reference to those figures.

It will be seen by reference to FIG. 2 that each of the pre-treating stations 24, 29, 34, and 39, and the rapid plating section 44 is not a tank per se. That is, there is no immersion of the workpieces, which are cylinder blocks that appear in certain of these figures and which are indicated generally by the reference numeral 49. These cylinder blocks 49 are held by a conveyor mechanism 51 that travels along a pair of spaced-apart guide rails 52 in a conventional manner by any type of known overhead conveyor. As may be seen in FIG. 3, the guide rails 52 are disposed so that they extend transversely outwardly beyond the various stations 24, 25, 28, 29, 33, 34, 38, 39, 43, 44, 47, and 48.

Also associated with each of the treating stations 24, 29, 34, 39, and 44 is an overhead assist or helper station, indicated generally by the reference numeral 53. Each helper station 53 has substantially the same construction, thus simplifying the overall mechanism. One of these stations will be described later by particular reference to FIGS. 7–9 and FIGS. 10 and 11, wherein it will be seen that the construction of each helper station 53 is the same.

Figure 4:
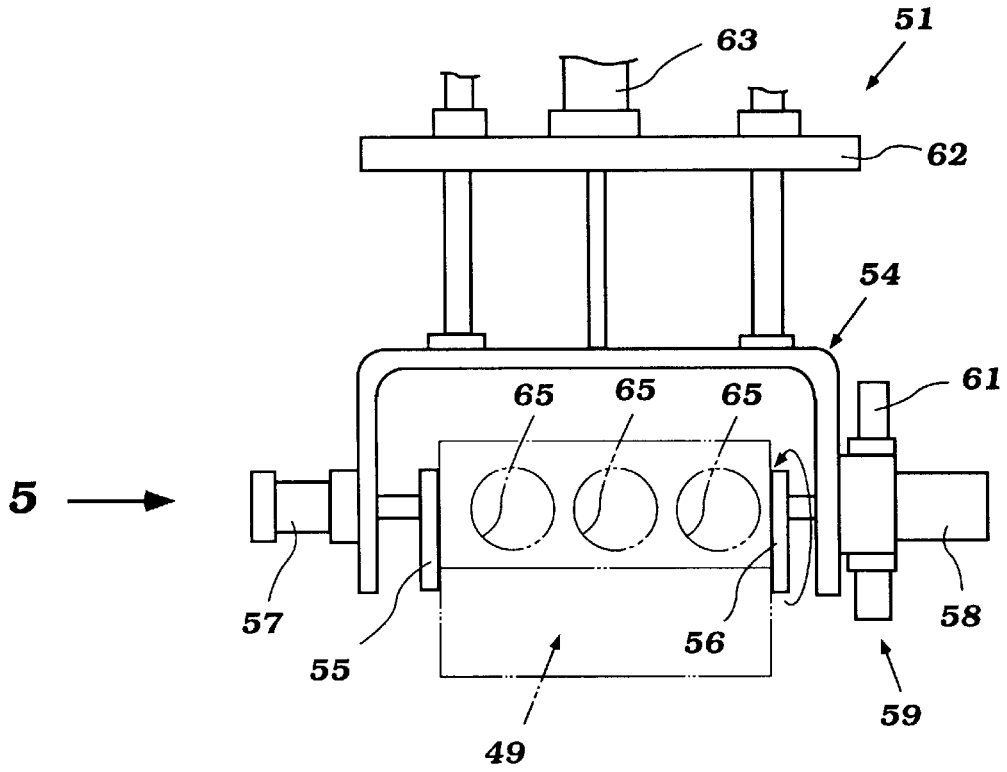
FIG. 4 is an enlarged end elevational view looking generally in the direction of the arrow 4 in FIG. 3 and shows the cylinder block manipulating mechanism in one position.
Figure 5:
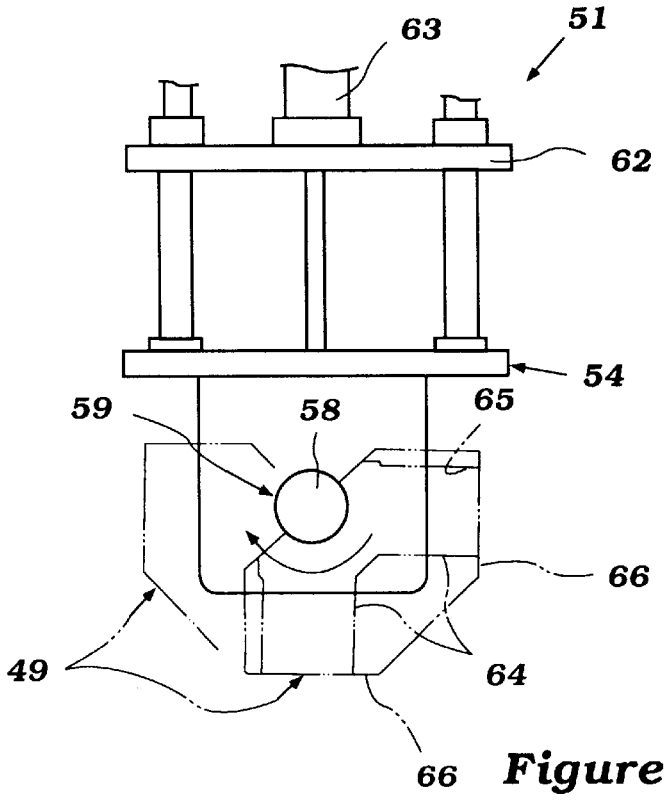
FIG. 5 is a view of the manipulating mechanism looking in the direction of the arrow 5 in FIG. 4.

Referring now to the conveyor mechanism 51, as shown in FIG. 4, each mechanism includes a yoke-shaped carrier 54 that carries at its opposite ends a pair of clamping assemblies 55 and 56. The clamping assembly 55 is movable between a clamped position holding one end face of the cylinder block 49, as shown in FIG. 4, to a release position by means of a pneumatic cylinder 57.

In a like manner, the clamp assembly 56 is actuated between its clamping position, as shown in FIG. 4, and a release position by a pneumatic actuator 58. However, this clamping end also has a rotating operator 59 that consists of a further pneumatic or hydraulic motor 61 which operates through a rack so as to rotate the clamping assembly 56 to rotate the cylinder block 49 between the two phantom positions shown in FIG. 5. Thus, the clamping assembly 55 is also journaled in the yoke 54 so as to permit this rotation.

The clamping mechanism as thus far described is carried on an elevator plate 62 that cooperates with the guide rails 52 for movement there along. The yolk-shaped carrier 54 can be raised and lowered relative to the plate 62 by a further pneumatic cylinder 63 so as to elevate the cylinder blocks 49 when they are moved from station to station and to lower the cylinder blocks 49 into the respective stations.

The construction of the cylinder blocks 49, although they may be of any conventional type having inclined cylinder banks, will now be described by reference also to FIGS. 4 and 5. As may be seen, each cylinder block 49 is formed with a pair of cylinder banks 64. Each of these cylinder banks 64 is provided with a plurality of cylinder bores 65. In the illustrated embodiment, the cylinder blocks 49 are for a V-6 engine having a 90° V angle. Hence, each cylinder bank 64 is formed with three cylinder bores 65. Although this is a described embodiment, it will be readily apparent to those skilled in the art how the invention can be utilized with cylinder blocks having other cylinder numbers and other V angles.

When the conveyor mechanism 51 moves along the guide rails 52 down the line 21, the cylinder blocks 49 are held in a first angular position, as shown by the dot double-dash line view of FIG. 5. In this position the top deck 66 of one of the cylinder banks faces in a downward direction for a reason which will become apparent shortly. The rotating operator 59 is operated to move the cylinder block 49 from this position to the other angular position, as shown in the dot-dash line of FIG. 5 for a reason which will also become apparent.

The construction of each of the treating stations, including the pre-treating stations 24, 29, 34, and 39, and the actual rapid plating station 44, and their association with their respective liquid storage tanks 26, 31, 35, 41, and 45, will be described by particular reference to FIG. 6, which actually shows the plating section 44 and its storage tank 45. Except for the few points which will be noted, each station has substantially the same construction.

The pump 46 picks up plating fluid from the bottom of the tank 45 and delivers it to the station 44 through a supply conduit 67. An automatic flow control valve 68 is provided in this supply conduit 67 for controlling the supply of fluid to the plating station 44. In addition, a manual shut-off valve 69 is put into this line. The amount of fluid flowing also is controlled by a bypass line 71 in which a bypass valve 72 is provided. The bypass valve 72 controls the flow by bypassing some of the plating fluid back to the tank 45 from the supply line 67.

Fluid is returned from the plating treatment station 44 through a return line 73. An automatic control valve 74 is provided in the line 73 for controlling the amount of return flow. In addition, a manual shut-off valve 75 is placed in this line.

The helper station or fixture 53 cooperates with the station 44 in a manner which will be described now in detail by reference to FIGS. 7–9. These figures also show in more detail the actual rapid plating section 44 which, in many regards, is similar to the pre-treating stations. However, these pre-treating stations will be described separately by reference to FIGS. 10 and 11, as already noted.

Figure 7:
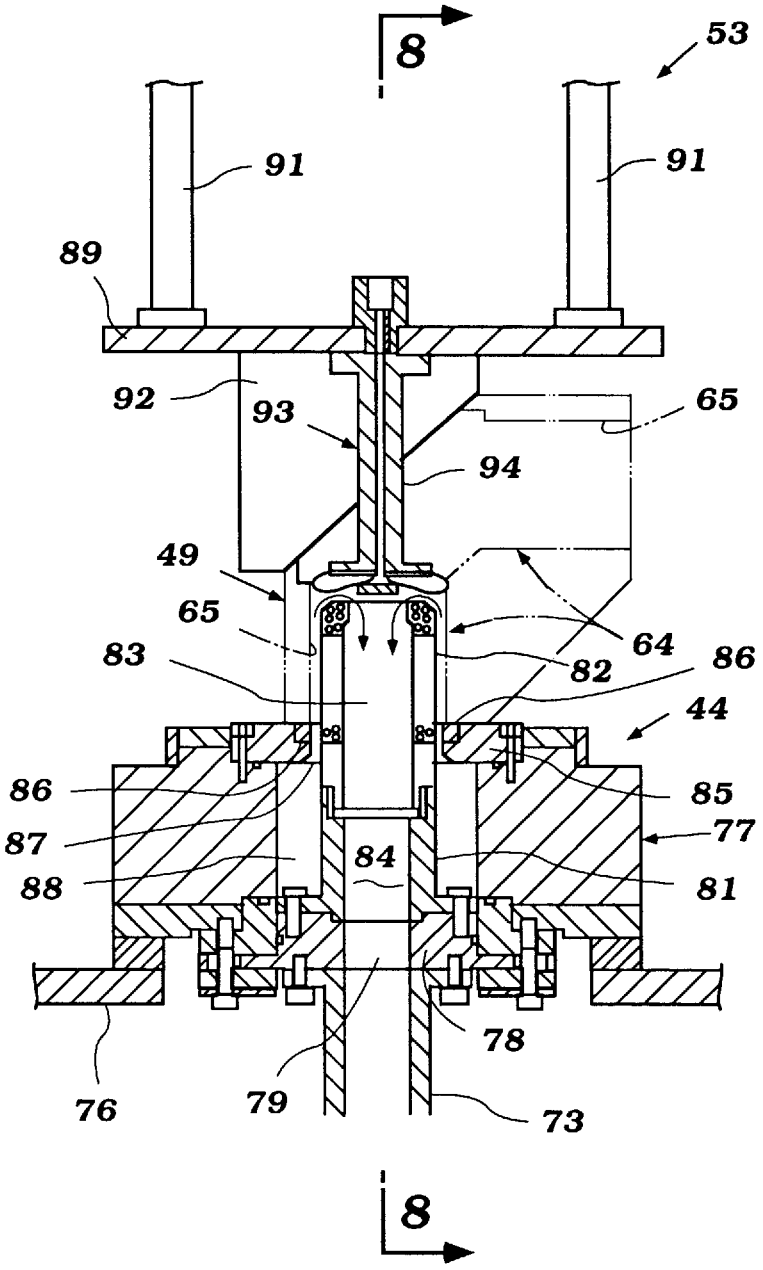
FIG. 7 is an enlarged cross-sectional view, in part similar to FIG. 5 but showing the cylinder block chemical treating in one station.
Figure 8:
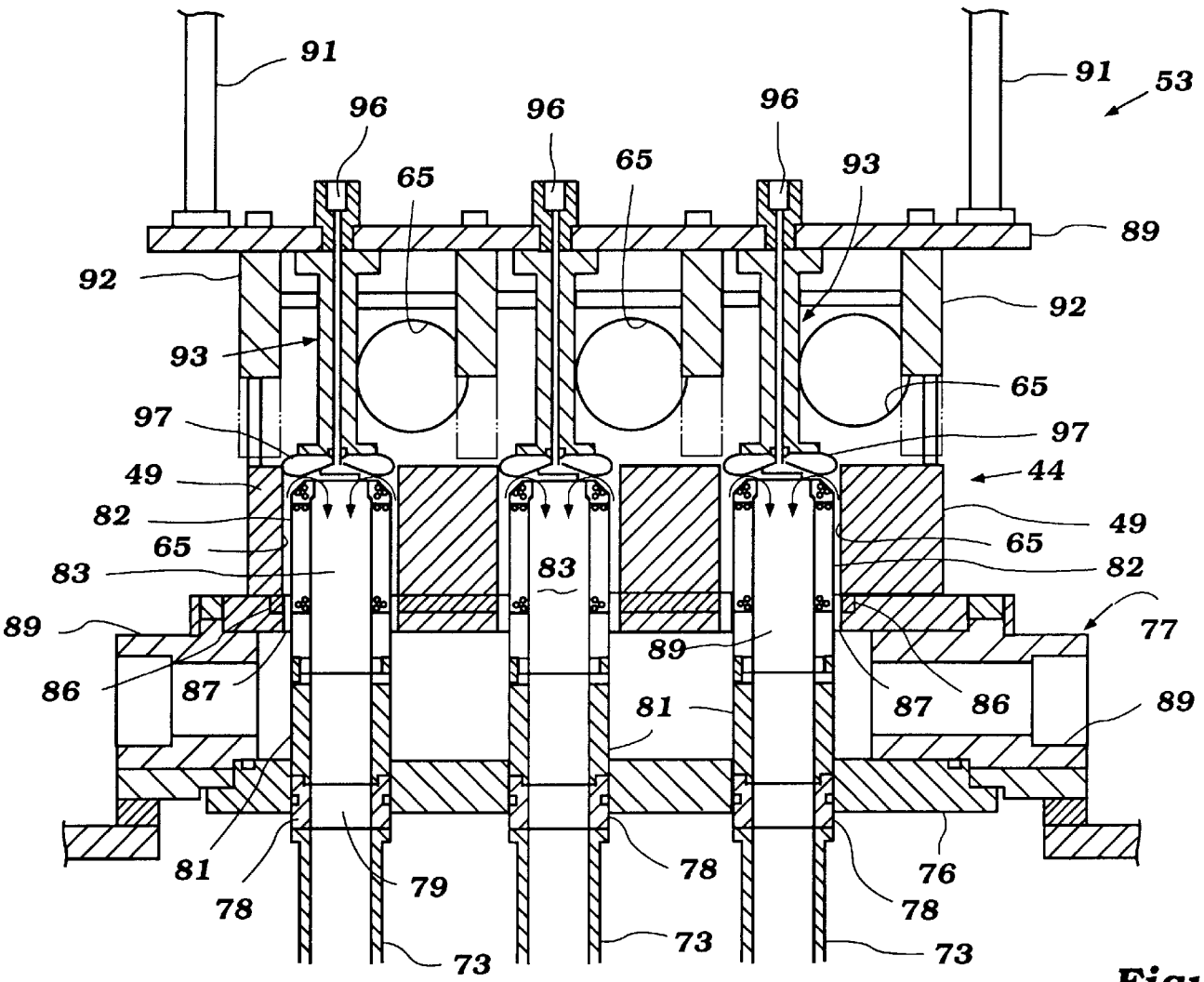
FIG. 8 is a cross-sectional view taken along the line 8—8 of FIG. 7.

As may be best seen in FIGS. 7 and 8, each rapid plating section 44 includes a base plate 76 on which a fixture, indicated generally by the reference numeral 77, is provided.

An adaptor plate 78 is attached to the fixture 77. This adaptor plate 78 has a flow passage 79 that communicates with the return line 73.

Mounted on the adaptor plate 78 is an electrode holder 81 which, in turn, mounts a tubular electrode 82 having a central flow path 83 which is generally disposed in line relationship with an opening 84 of the adaptor plate 78 and passage 79.

Mounted on the upper portion of the fixture 77 is a cylinder block face support plate 85 that carries an annular seal 86 that is adapted to be in sealing engagement with the upper portion of the cylinder bank 64 around the individual cylinder bores 65. Hence, there is a fluid-tight seal formed around the cylinder head receiving end of the cylinder bank 64 by this assembly. These surfaces are held in engagement by the helper station 53 in a manner which will be described.

The support plate 85 has a flow passage 87 which communicates with a fluid inlet manifold 88 that is formed within the fixture 77 and which communicates at one end or both ends through fittings 89 (FIG. 8) with the supply conduit 67 for delivering the plating fluid.

The helper fixture 53 performs two important functions. First, it holds the cylinder block 49 in place so that its upper deck is in sealing relationship with the seal 86. In addition, it supplies a seal for the crankshaft end of the cylinder bores 65. This construction will now be described by primary reference to FIG. 9, even though it also appears in FIGS. 7 and 8. However, before referring to FIG. 9 in detail, the mounting arrangement for the helper fixtures 53 will be described by primary reference to FIGS. 7 and 8.

The helper fixture 53 includes a base plate 89 that is supported for reciprocal motion in a vertical direction by a pair of guide posts 91. The guide posts 91 are actuated by a suitable pneumatic or hydraulic motor to move in the vertical direction between a retracted position and an engaged position, which latter position is shown in FIGS. 7–9. In this engaged position, locator blocks 92 engage the skirt or crankshaft end of the cylinder block 49 and hold it in position.

Carried on the plate 89 are three sealing assemblies, each indicated by the reference numeral 93. These sealing assemblies 93 include post-like members 94, as best seen in FIG. 9, which have flow paths 95 that extend through them. A fitting 96 on the upper side of the plate 89 is adapted to be connected to a flexible supply conduit which leads to a source of controlled pneumatic pressure.

At the lower end of the post 94, there is provided a pneumatic bladder member 97 formed from a suitable resilient material and which is pressurized interiorally through a T fitting 98.

Figure 9:
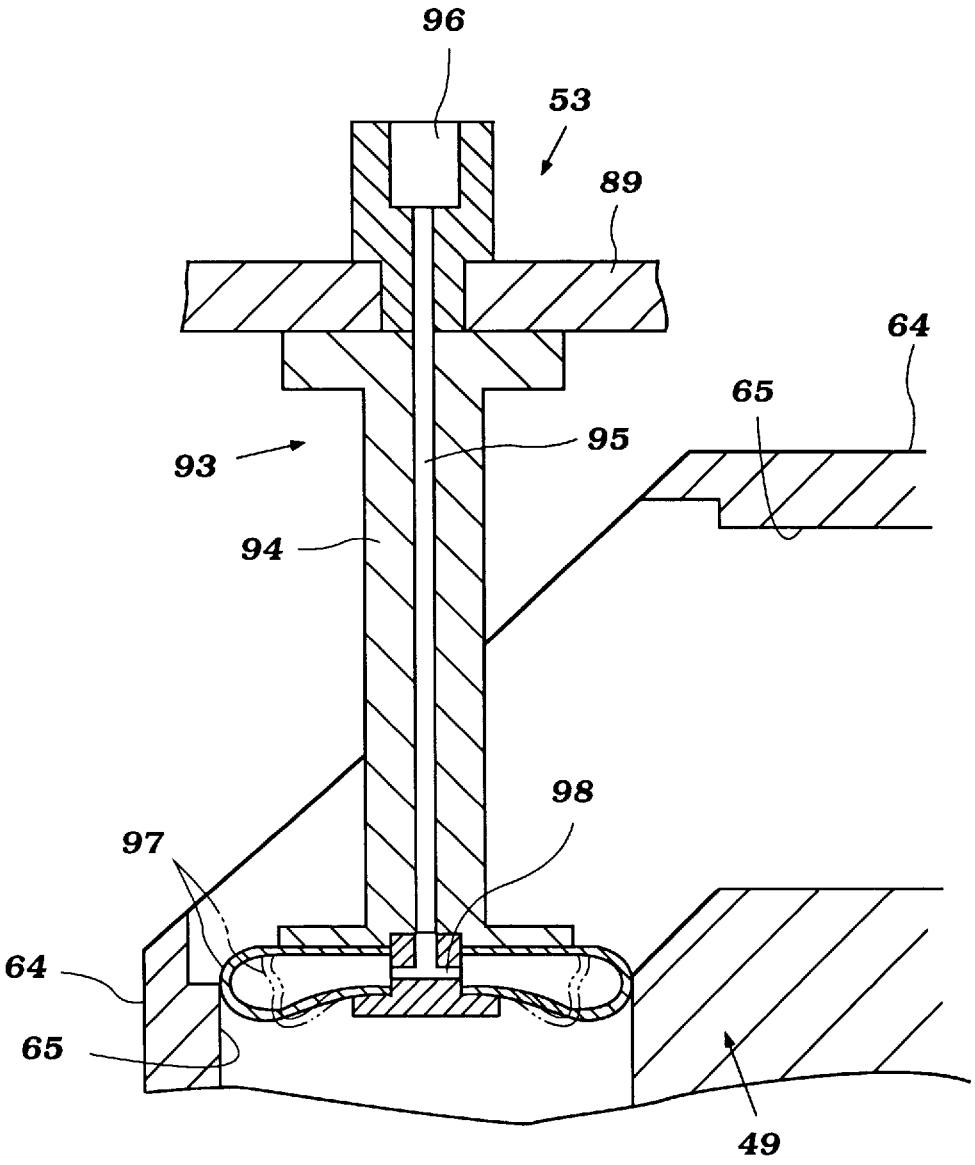
FIG. 9 is an enlarged cross-sectional view taken generally in the same direction as FIG. 7 and shows the helper, sealing and hold-down mechanism.

As may be seen in FIG. 9 from the broken-line view, when the helper member 53 is being lowered, the air pressure is released and the bladder member 97 will retract clear of the cylinder bore 65. When the locater block 92 engage the cylinder block 49, downward movement will be precluded. Then the seal 97 is pressurized through the fitting 98, conduit 95, and T fitting 98 so as to inflate the device and bring it into sealing engagement with the crankcase ends of the cylinder bore 65. Hence, when the construction is in place, the upper or crankcase ends of the cylinder bores 65 will be effectively sealed.

When this occurs, then the flow of plating fluid is begun through the fluid path already described. This causes fluid to enter the area in the cylinder bore 65 around the tubular electrode 82 through the flow passages 88 and 87. Fluid flows axially along the cylinder bores 65 from the head end toward the crankshaft end. At the same time, an electrical potential is passed between the electrode 82 and the cylinder block 49 to cause the deposition of the plating material.

Since the bladder member 97 is in its lowered position spaced from the upper end of the annular electrode 82, the electrolyte may flow radially across the electrode 82 and down through its central flow passage 83, as shown by the arrows in FIGS. 7 and 8. The plating liquid is then returned to the storage tank 45 through the return line 73 already described.

Because of the high velocity of flow, it is possible to use a relatively high electrical potential, and the plating of the cylinder bores 65 can be done in a very rapid and high-efficiency manner.

The construction and operation of the various pre-treating sections 24, 29, 34, and 39 will now be described by primary reference to FIGS. 10 and 11. Helper fixtures 53 cooperate with each of these stations, and those helper fixtures 53 are, as has been noted, the same as those previously described. Therefore, the same reference numerals utilized to describe the helper fixtures 53 associated with the rapid plating station 44 are utilized in these figures.

The pre-treating stations 24, 29, 34, and 39 all have a construction which is generally the same as the plating station, but there are some differences, and hence the pre-treating station, such as the station 34, will be described by reference to these figures. Like the actual rapid plating station, there is provided a base plate 99 on which a supporting fixture 101 is mounted. The fixture 101 carries a return manifold 102 which has a plurality of return ports 103, each of which communicates with a manifold branch 104. The manifold branch 104 is, in turn, in communication with a return conduit 105 of the pumping system.

The fixtures 101 carry cylindrical posts 106 which are not electrodes, but merely provide a central flow path 107. The fixture 101 has a cavity 108 which communicates at one or both ends with fittings 109 that are supplied by the pump of the respective stations.

Annular gaps 111 are formed around each of these tubular members 106. A cylinder block mounting plate 112 has a gasket 113 which sealingly engages the cylinder block bank 64 around the cylinder bore 65 in the same manner as previously described. An annular gap 114 permits the pre-treating fluid to flow upwardly in the area between the cylinder bore 65 and the outer surface of the tubular members 106.

As with the rapid plating station, the bladder members 97 seal the crankcase ends of the cylinder bores, but permit fluid to exit down through the opening 107 of the tubular member to the return manifold 104 and return conduit 105. Thus, by moving the cylinder block 49 along the treating section 21, it is possible to rapidly plate the cylinder bore 65 of one cylinder bank 64.

At the end of the line 21, there is provided a transfer conveyor, indicated generally by the reference numeral 121, that is employed for transferring the cylinder blocks 49 from the line 21 to the line 22. It should be noted that the line 22 is exactly the same as the line 21, except that the order of the stations is reversed. Thus, each station of the line 22 has been identified by the same reference numeral utilized to identify the like station of the line 21, but the suffix "-2" has been added to the reference numeral. In essence, the transfer mechanism may actually move the entire conveyer mechanism 51 from one side pair of guide rails 52 to another pair of guide rails 52-2. At the same time the cylinder blocks 49 are transferred from the line 21 to the line 22, the motor 61 (FIG. 4) is activated so as to rotate the cylinder block from the double dot-dash line position of FIG. 5 to the dot-dash line position of this same figure. Hence, the remaining untreated cylinder bank 64 will now have its cylinder bore 65 disposed in vertical orientation for treatment in the manner as already described.

Thus, the double treatment of the cylinder block 49 may be accomplished in a line that does not take up significant length, but merely permits the transfer of the blocks 49 from one line to the other that extend in parallel and close side-by-side relationship. The line 22 ends with a removal station 112 from which the finished and completely plated cylinder blocks 49 are removed. In view of the previous description, it is not believed necessary to describe how this same plating technique is accomplished on the remaining cylinder bank 64.

Figure 12:
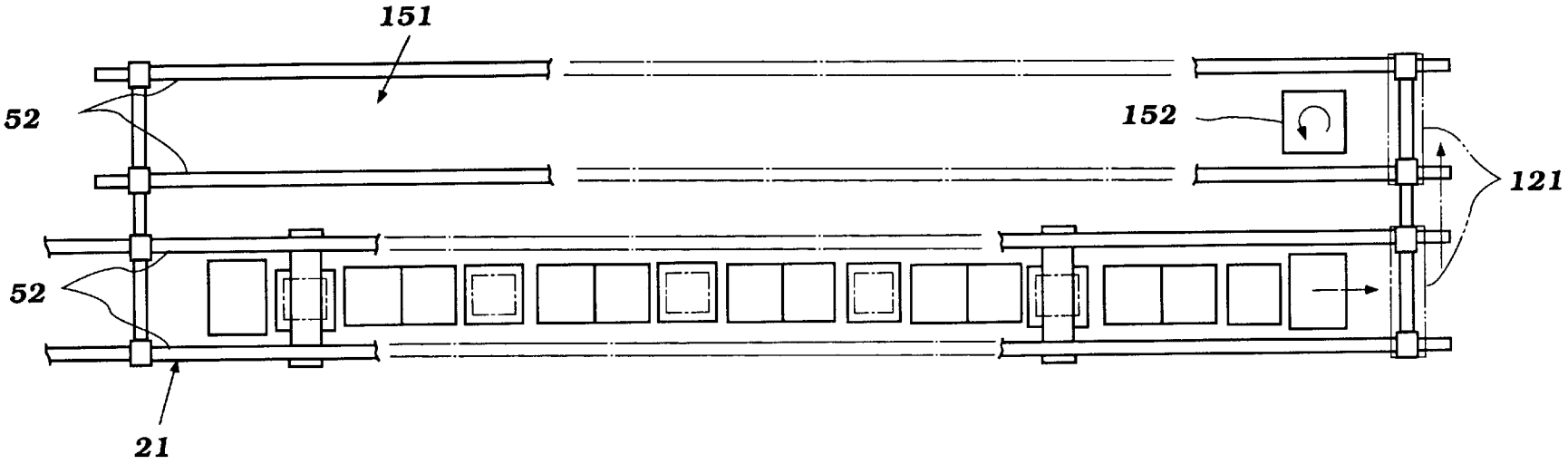
FIG. 12 is a top plan view, in part similar to FIG. 3, and shows another apparatus and method for practicing the invention.

In the embodiment of the invention thus far described, the plating section for plating both cylinder banks has utilized two separate treating lines, the lines 21 and 22, one for each cylinder bank. FIG. 12 shows another embodiment of the invention wherein only one plating line, indicated by the reference numeral 21, is employed. However, this embodiment still maintains the short overall length for the plating line while still permitting both banks to be plated in sequence. In this arrangement there is provided a separate return conveyor, indicated generally by the reference numeral 151, that is disposed on one side of the treating line 21 in the same location as the second treating line 22 of the previously described embodiment.

Again, a transfer conveyer 121 transfers the holding devices 51 from the conveyor line 52 to the conveyor line 151, which also has parallel rails 52. The conveyor mechanism may be the same as that previously described, and in this embodiment there is a conveyor mechanism 121 at each end of the line 21. Preferably, there is a turntable 152 provided at the beginning of the conveyor line 151 on which the cylinder blocks are placed when transferred from the line 21 to the conveyor line 151. On this station, the cylinder blocks are rotated end for end and then picked up again and transferred back to the line 21 for plating of the remaining cylinder bank. In this manner the hold down portions of the helper stations 53 may be utilized in each direction. At the same time, the cylinder banks are rotated, as shown in FIG. 5. In all other regards, this embodiment is the same as those previously described, and for that reason, further description of this embodiment is not believed to be necessary.

Figure 13:
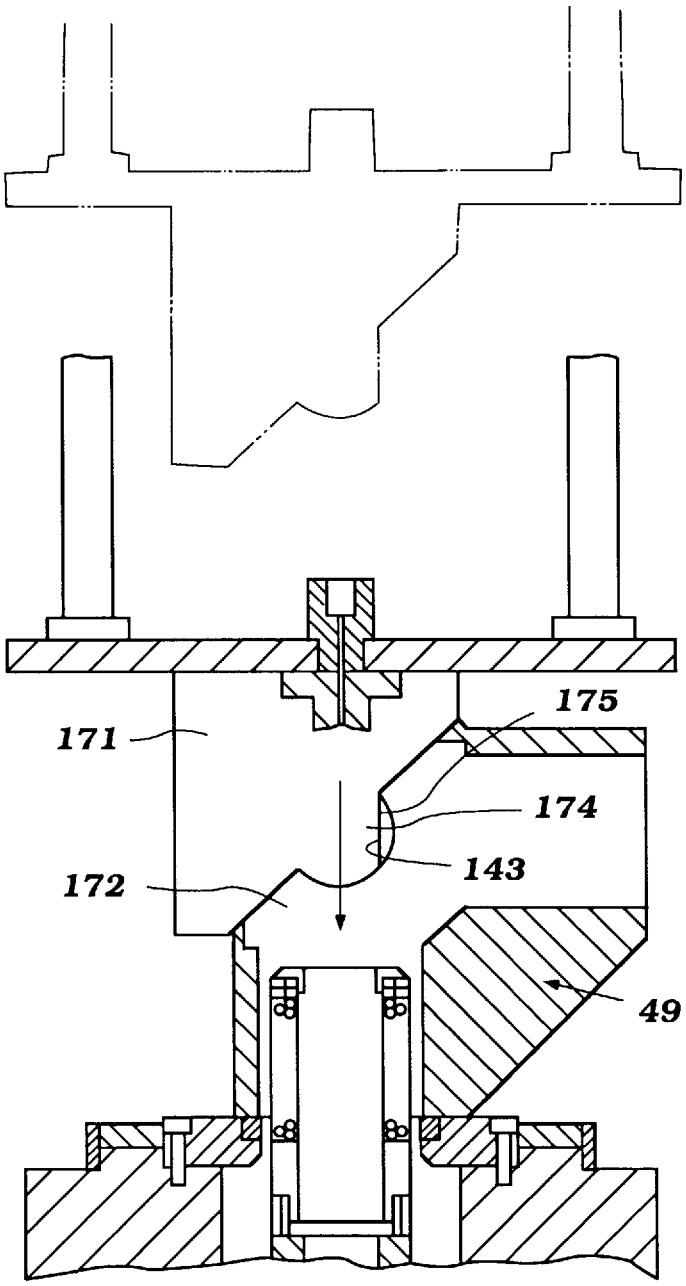
FIG. 13 is a cross-sectional view, in part similar to FIG. 7, and shows another embodiment of the invention.
Figure 14:
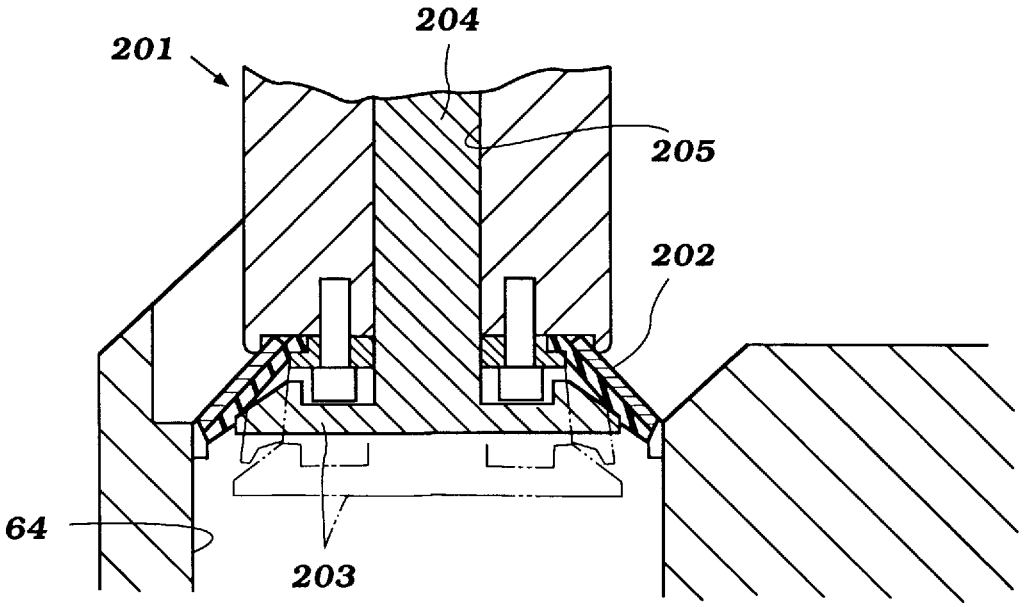
FIG. 14 is a further enlarged cross-sectional view of still another embodiment of the invention.

FIGS. 13 and 14 show yet another embodiment of the invention. When utilizing a line of the type shown in FIG. 12, the locator blocks 92 of the helper stations 53 must be designed so that they can accommodate the cylinder block in either direction. Another arrangement of locating the cylinder blocks is shown in FIG. 13. This embodiment differs from those already described only in the configuration of the holding plates, indicated by the reference numeral 171 in this figure. It will be seen that the cylinder block 49 is formed with a web 172 in which the crankshaft main bearing journal surfaces 173 are formed.

The holding plates 171 can have a generally cylindrical holding section 174 that cooperates with these surfaces in order to hold the cylinder blocks 49 in sealing arrangement. When such an arrangement is utilized, the holding section 174 is provided with a cutout 175 so as to permit its insertion, as should be readily apparent.

FIG. 14 shows another embodiment which differs from the previous embodiments only in the particular seal used for the crankcase end of the cylinder bore 65. In this embodiment the helper member is provided with a cylindrical post 201 which carries on it a skirt-type seal 202, which is normally biased to a retracted position, as shown in the dash-double dot line portion of this figure. An expanding head 203 has a post 204 that is received in a bore 205 of the helper post 201. This member is lowered upon insertion into the cylinder bores 65 whereon the sealing members 202 will clear the bores.

Upon installation, the post 204 is raised to move the skirts 202 out into sealing engagement with the lower or crankshaft ends of the cylinder bore 65 to effect sealing.

Thus, from the foregoing description it should be readily apparent that the described embodiments of the invention provide a very effective method and apparatus for treating the cylinder blocks having angularly disposed cylinder banks. Of course, the foregoing description is that of preferred embodiments of the invention. It will be readily apparent to those skilled in the art how various changes and modifications may be made without departing from the spirit and scope of the invention, as defined by the appended claims.

What is claimed is:

1. An apparatus for chemically treating cylinder bores of a cylinder block having a pair of angularly inclined cylinder banks, each having at least one cylinder bore formed therein, said apparatus comprising a treating section for establishing a flow of treating fluid through a cylinder bore from one end to the other for chemically treating said cylinder bore, a manipulating device for moving cylinder blocks through said treating section, and means associated with said manipulating device for placing said cylinder blocks in a first orientation for flow of the treating fluid through one of said cylinder banks and then in a second orientation for flow of the treating fluid through the other of said cylinder banks.

2. An apparatus as in claim 1, wherein the treating section includes a base upon which cylinder head engaging surfaces of the cylinder banks are supported.

3. An apparatus as in claim 2, wherein the flow of the treating fluid enters the cylinder bore and exits the cylinder bore at the same end thereof.

4. An apparatus as in claim 3, wherein the treating section includes a tubular member that is adapted to extend into the cylinder bore to form a first flow path between the outer surface of the tubular member and the inner surface of the cylinder bore and a second flow path through the center of the tubular member.

5. An apparatus as in claim 4, further including means for establishing an electrical potential between the tubular member and the cylinder block for effecting electroplating thereof.

6. An apparatus as in claim 5, further including a helper member associated with the treating section for effecting a seal at the other end of the cylinder bore.

7. An apparatus as in claim 6, wherein the treating fluid is entered into initial contact with the cylinder bores at the cylinder head engaging surfaces thereof.

8. An apparatus as in claim 1, wherein the treating section includes a plurality of stations in a first line to which the cylinder blocks are delivered, one after the other.

9. An apparatus as in claim 8, further including a second line including a plurality of stations extending in parallel to the stations of the first line.

10. An apparatus as in claim 9, further including means for moving the cylinder blocks along the stations of the first line for chemical treatment of one of said cylinder banks in the first orientation, means for transferring the cylinder blocks to the second line, and means for subsequently chemically treating the other of said cylinder banks.

11. An apparatus as set forth in claim 10, wherein the stations of the second line also include a treatment section and the cylinder bore of the one of the cylinder banks is treated on the first line and the cylinder bore of the other of the cylinder banks is treated on the second line.

12. An apparatus as set forth in claim 11, wherein the stations of the first and second lines are reversed.

13. An apparatus as set forth in claim 10, wherein the second line comprises a return line and further including transfer means at each end of each line for transferring the cylinder blocks from one line to the other.

14. An apparatus for chemically treating cylinder bores of cylinder blocks having a pair of angularly inclined cylinder banks, each having at least one cylinder bore formed therein, said apparatus comprising a pair of parallel conveyors having respective paths lying in side-by-side relationship, a treatment section provided along one of said paths and adapted to provide an area for a flow of treating fluid through a cylinder bore from one end to the other for chemical treating of the cylinder bore, one of said conveyors moving the cylinder blocks along said one path for chemical treatment of said cylinder bore of one of said cylinder banks in a first orientation, means for transferring the cylinder blocks to the other path and to a second orientation different from said first orientation, and means for subsequently chemically treating the cylinder bore of the other of said cylinder banks of the cylinder blocks.

15. An apparatus as set forth in claim 14, wherein the other of the paths also includes a treatment section and the other of the cylinder banks is treated on the other path.

16. An apparatus as set forth in claim 15, wherein the treatment sections comprise a plurality of treating stations.

17. An apparatus as set forth in claim 16, wherein the treating stations of the treatment sections are reversed.

18. An apparatus as set forth in claim 14, wherein the other path comprises a return path and further including transfer means at each end of each path for transferring the cylinder blocks between the respective paths.

19. An apparatus as set forth in claim 18, wherein the treatment section comprise a plurality of treating stations.

20. An apparatus as set forth in claim 19, wherein the treatment section lies along only one path.

21. A method of chemically treating cylinder bores of a cylinder block having a pair of angularly inclined cylinder banks, each having at least one cylinder bore formed therein, said method comprising the steps of establishing a flow of treating fluid through a cylinder bore from one end to the other for chemically treating said cylinder bore, moving the cylinder block through a treatment section, and placing said cylinder block in a first orientation for flow of the treating fluid through the cylinder bore of one of said cylinder banks and then in a second orientation for flow of the treating fluid through the cylinder bore of the other of the cylinder banks.

22. A method as in claim 21, wherein the flow of the treating fluid enters and exits each cylinder bore at the same end thereof.

23. A method as in claim 22, further including establishing an electrical potential for effecting electroplating.

24. A method as in claim 21, further including moving the cylinder block along a first line for chemical treatment of the cylinder bore of one of said cylinder banks in the first orientation, transferring the cylinder block to a second line, and subsequently chemically treating the cylinder bore of the other of said cylinder banks.

25. A method as set forth in claim 24, wherein the other of the cylinder banks is treated on the second line.

26. A method as set forth in claim 25, wherein the chemical treatment performed on each line is done in a plurality of treating steps and the treating steps on the lines are reversed.

27. A method as set forth in claim 24, wherein the second line comprises a return line and further including the step of transferring the cylinder block from one line to the other.

28. A method for chemically treating the cylinder bores of a cylinder block having a pair of angularly inclined cylinder banks, each having at least one cylinder bore formed therein, said method comprising the steps of transporting the cylinder block along paths lying in side-by-side relationship, providing a flow of treating fluid through a cylinder bore from one end to the other for chemical treating of the cylinder bore along each of the paths, moving the cylinder block along one of said paths for chemical treatment of only one of said cylinder banks along said one path, transferring the cylinder block to the other path, and subsequently chemically treating only the cylinder bore of the other of the cylinder banks along the other path.

29. A method as set forth in claim 28, wherein the other of the cylinder banks is treated on the other path.

30. A method as set forth in claim 29, wherein the treatment of each cylinder bank is done in a plurality of treating stations located along the paths.

31. A method as set forth in claim 30, wherein the treating stations along one of the paths are reversed from those along the other of the paths.

32. A method as set forth in claim 31, wherein the other path comprises a return path and further including the steps of transferring the cylinder block from the one path to the other path at the end of at least one path.

33. A method as set forth in claim 28, wherein the treatment is done along only one path.

* * * * *